United States Patent [19]

Jean et al.

[11] 4,093,840

[45] June 6, 1978

[54] PARALLEL ARRANGEMENT OF APPLICATOR AND PROCESS FOR APPLYING MICROWAVES TO A MATERIAL

[76] Inventors: Olivier A. Jean, 12 avenue Lavoisier, 78600 Maisons Laffitte; Georges Roussy, 17 rue Ernest Renan, 54520 Laxou, both of France

[21] Appl. No.: 699,435

[22] Filed: June 24, 1976

[30] Foreign Application Priority Data

Jul. 4, 1975 France ..... 75-21064

[51] Int. Cl.[2] ..... H05B 9/06

[52] U.S. Cl. ..... 219/10.55 F; 219/10.55 A; 219/10.55 M

[58] Field of Search ..... 219/10.55 A, 10.55 F, 219/10.55 M; 34/1; 333/11, 95 R, 95 S

[56] References Cited

U.S. PATENT DOCUMENTS

| | | | |
|---|---|---|---|
| 2,634,331 | 4/1953 | Honda | 333/11 |
| 2,709,789 | 5/1955 | Worrell | 333/11 |
| 2,764,740 | 9/1956 | Pratt | 333/11 |
| 3,517,351 | 6/1970 | Grossbach | 333/11 |
| 3,670,133 | 6/1972 | Admiraal | 219/10.55 A |
| 3,711,674 | 1/1973 | Admiraal | 219/10.55 A |

FOREIGN PATENT DOCUMENTS

| | | | |
|---|---|---|---|
| 649,067 | 1/1951 | United Kingdom | 333/11 |
| 521,156 | 1/1956 | United Kingdom | 219/10.55 A |

OTHER PUBLICATIONS

Lab Notes, A Microwave Fabry-Perot Interferometer, Artman 11/52.

*Primary Examiner*—J. V. Truhe
*Assistant Examiner*—Bernard Roskoski
*Attorney, Agent, or Firm*—Flynn & Frishauf

[57] ABSTRACT

In a process for applying microwaves to a material, consisting in applying two beams from a single source to an inlet face of the material putting in phase, the beams reflected by the inlet face of the material superposing the two reflected beams to form a superposed beam, which is returned into the material, the improvement which consists in that the material is divided into two portions which are electromagnetically decoupled.

4 Claims, 3 Drawing Figures

PARALLEL ARRANGEMENT OF APPLICATOR AND PROCESS FOR APPLYING MICROWAVES TO A MATERIAL

BACKGROUND AND PRIOR ART

The invention relates to processes and applicators for applying waves to a material, in particular to a confined body of material at least one of whose main components is a dielectric, particularly in the solid or liquid phase, the waves being electromagnetic microwaves with frequencies between 1 MHz and 40 GHz, or better still between 500 MHz and 4 GHz.

An applicator consists essentially of a waveguide for microwaves, whose inlet is coupled to a generator as a source of these waves. The waveguide also serves as a receptacle or tunnel for the material being treated, or the waveguide can terminate in a horn, which contains the material. In the present context the inlet face of the waveguide means the face of the material, or the face of the receptacle which contains the material, if the material is a fluid or a dispersion. This is the face through which the incident waves from the generator penetrate into the material. The outlet face of the waveguide is the face of the material through which the wave emerges. In those cases where the inlet face is not perfectly defined geometrically, the face is the plane, perpendicular to the direction of propagation of the wave, at which the energy conveyed by the incident wave is reflected or modified due to the presence of the material or its associated devices. This definition for the inlet face allows one to define unambiguously the complex coefficient of reflection at the inlet of the waveguide, for the mode of propagation, or modes of propagation, in question, and by deduction the inlet and outlet impedances.

Applicators of this kind are used in a variety of technical fields, ranging from the processing of foods, the heating of insulating materials, the drying of adhesives, the setting of concretes and the formation of polymers to desorbtions and other physical and chemical processes.

The yield of a process of this kind, that is to say the ratio of the energy consumed in the waveguide to the energy in the incident wave, is greater the less the wave is reflected from the inlet face. Reflection from the inlet face also has other disadvantages, in that a system of stationary waves is formed which impairs the good functioning of the generator. Furthermore it is often necessary to prevent reflection from the inlet face for the safety of the personnel working in the neighbourhood of the installation.

An apparatus described in the U.S. Pat. No. 3,712,971 comprises two waveguides coupled to a generator and equipped with slots through which the material being treated can pass. Means are provided for preventing the reflected microwave energy from reaching the generator. But a wave passing through one of the waveguides can return through the other one to the generator without having been reflected, damaging the generator. Furthermore controls of the apparatus depends on the humidity of the material being treated, which is always changing.

The invention gets over these difficulties by preventing the wave which has passed through one of the waveguides from returning through the other, even if the apparatus is not correctly adjusted.

SUBJECT MATTER OF THE INVENTION

The process according to the invention, which is particularly useful in an applicator, consists in balancing against each other the reflections of at least two identical applicators. The process consists in that two beams from a single source are applied to an inlet face of the material, the beams reflected by the inlet face of the material are put in phase and the two reflected beams are superposed to form a superposed beam, which is returned into the material. The process is characterized in that the material is divided into two portions which are decoupled in the electromagnetic sense.

This not only allows the reflected energy to be reused, that is to say re-cycled, but also prevents it from returning to the generator. A still more important advantage obtained is that even if the applicator is not correctly adjusted one can nevertheless be quite sure that a wave passing through one portion of the apparatus does not emerge through another portion, entirely changing the field there. In particular the reflected waves can be put in phase by arranging two portions in such a way that the lengths of the parts followed by the incident waves opposed in phase as far as the inlet faces differ by $(2k+1)\lambda/4$, where $k$ is a whole number and $\lambda$ is the wavelength, and reflecting the reflected superposed waves again onto the inlet faces.

A reactor according to the invention can comprise two waveguides coupled to a generator, a phase shifter acting on the waves reflected by the inlet faces of the two waveguides, and a device for sending these reflected waves to the inlet faces, the reactor being characterized in that the two waveguides are decoupled from each other in the electromagnetic sense.

The phase shifter can be formed by staggering the inlet faces of the waveguides in the direction of propagation of the waves in the waveguides. The two waveguides and the phase shifter can with advantage consist of a single tube divided into two waveguides by a longitudinal wall. The paths followed by the two waves can be given different lengths by making the inlet faces slope, that is to say form an angle with the direction of propagation of the wave, for example the inlet face can slope from its upper edge to its lower edge.

In a preferred version of the invention the two waveguides consist of two conjugated branches of a waveguide junction with four branches, a generator being coupled to a third branch and a mirror installed in the fourth branch. A mirror for the waves is an electric conductor which forms a short circuit at hyper frequencies. It generally consists of a plate or window which can, if desired, allow a stream of fluid to flow in the direction of the material being treated. The junction is preferably a directional coupling of 3 db, or a hybrid T junction. The mirror is in the shank of the T and the generator is coupled to the branch conjugated with the shank, or inversely.

The arrangement provides a branch forming an opening which can be utilized for intervention in the reactor, or simply for feeding the reactor, by coupling the branch to a source of fluid. This alone is sufficient to justify the use of the junction, because the opening provided does not disturb the supply of energy to the two reactors. The opening intervenes only if the reactors themselves are out of adjustement, in which case the intervention is proportional to the energy reflected by each of the reactors.

A further object of the invention is therefore to provide a reactor for applying waves to a material, the reactor comprising a waveguide junction with four branches, a generator of electromagnetic waves coupled to one of the branches and, preferably, a mirror situated in the branch conjugated with the branch coupled to the generator, this conjugated branch being connected to a source of fluid. The mirror has a cross section smaller than the cross section of the branch in which it is installed.

The drawings, which are given merely to provide examples, show:

Figure 1:
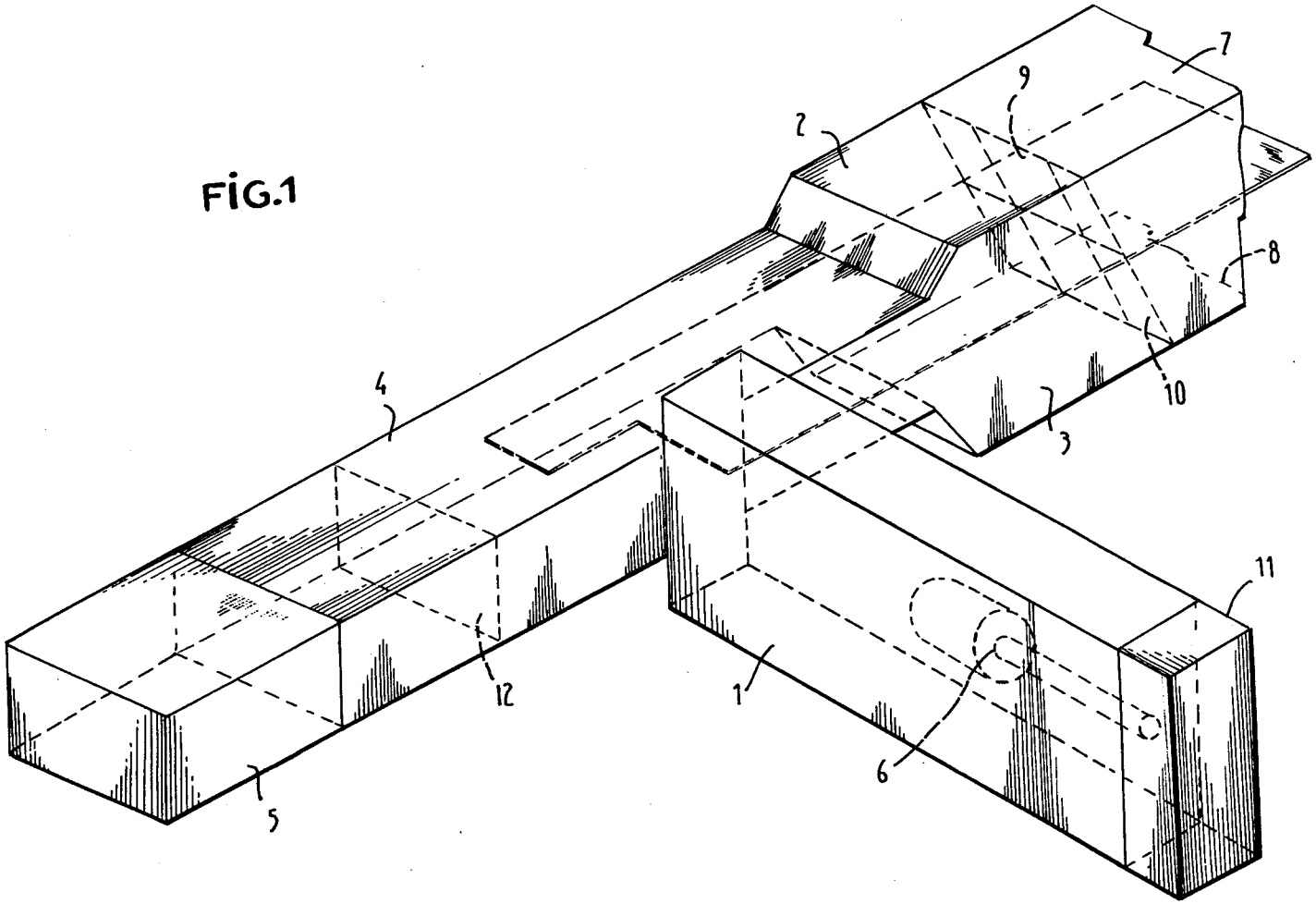
FIG. 1 is a diagrammatical perspective view of a reactor according to the invention.

In this example the reactor is for regenerating an absorbent molecular screen. The reactor consists of a hybrid T junction with four branches 1, 2, 3, 4. A junction of this kind is described in detail in the relevant textbooks, for example in Harvey "Microwave Engineering" 1963, Academic Press, London and New York, pages 115 to 120.

A magnetron 5 is mounted in the branch 4. A mirror 6 is mounted in the branch 1, conjugated with the branch 4. Two cartridges 7 and 8 containing absorbent screens are mounted in the branches 2 and 3 respectively.

The inlet faces 9, 10 of the cartridges form an angle with the common longitudinal direction of the branches 2 and 3 so that the centres of the faces are at a longitudinal distance apart of ¼ of a wavelength. A source 11 of air communicates with the branch 1. The mirror 6 occupies only a fraction of the cross section of this branch. A shield 12, tight against air and fluids, is mounted in the branch 4 between the magnetron 5 and the centre of the T.

It is known that if a generator 5 is coupled to the branch 4 there issue from the branches 2 and 3 two waves each with half the amplitude of the wave emitted by the generator 5, the two waves being opposed to each other in phase. Nothing issues from the branch 1. It is also known that if a generator is coupled to the branch 1, it produces two waves in the branches 2 and 3, the two waves having the same amplitude and being in phase with each other. Nothing issues from the branch 4.

Figure 2:
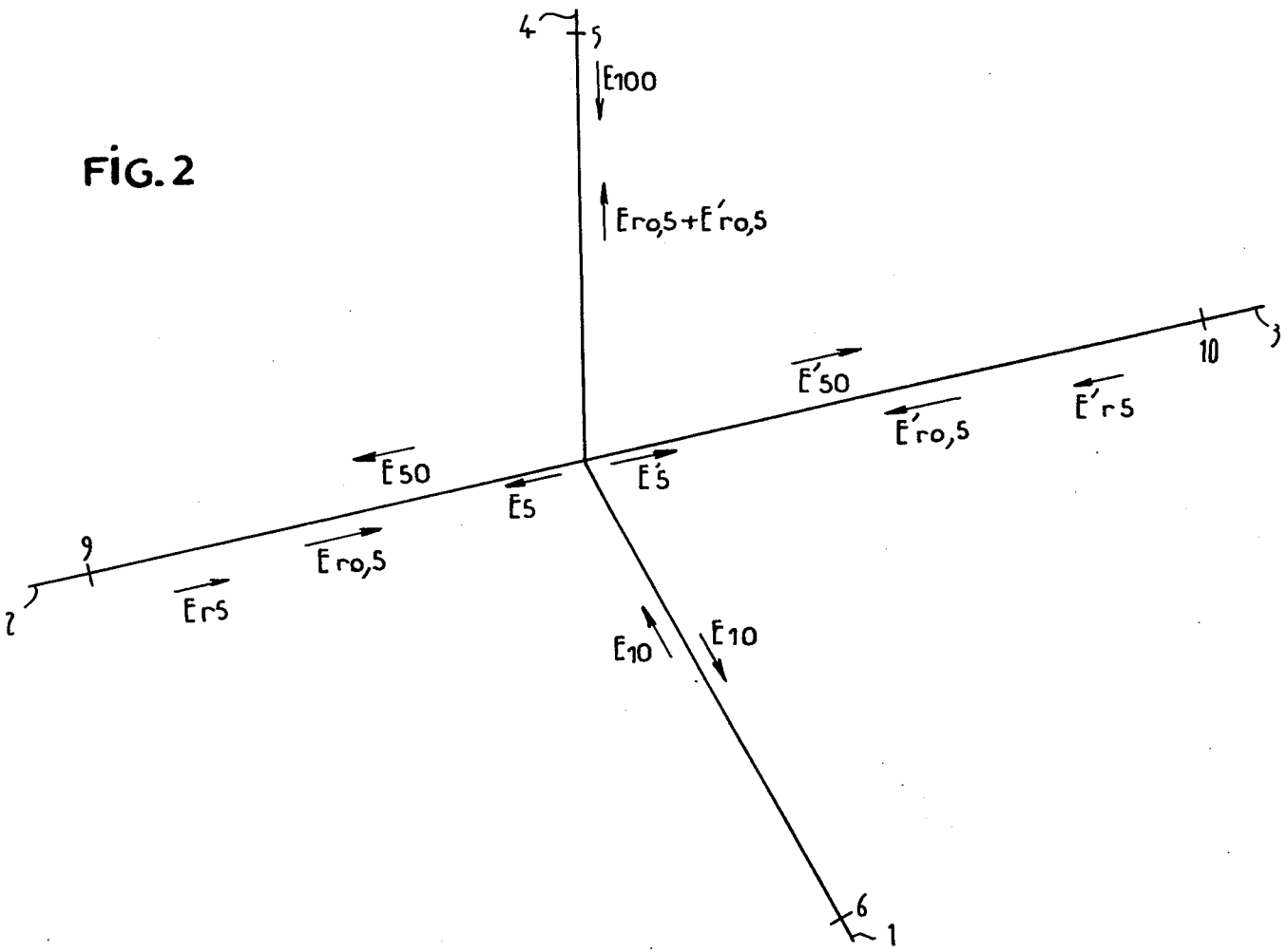
FIG. 2 is a diagram illustrating the method of functioning of the device.
Figure 3:
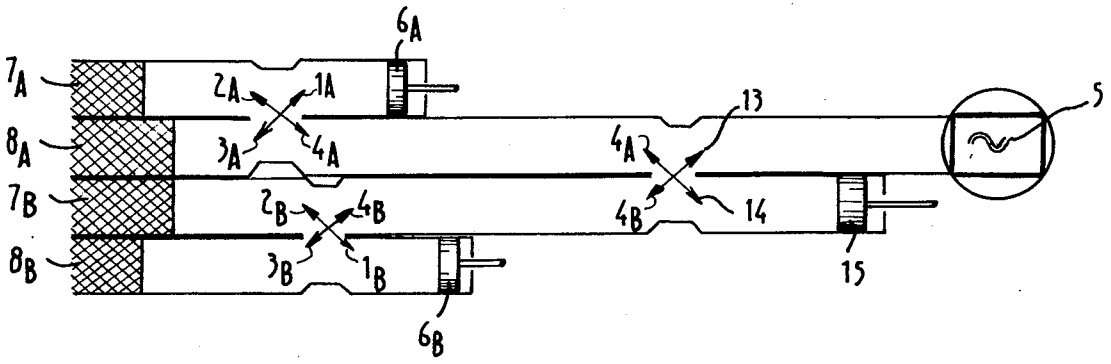

These two properties are applied as shown in FIG. 2.

A unimode wave E 100 of amplitude 100 is sent into the branch 4 by the magnetron 5. The wave distributes to the branches 2 and 3 two equal waves E 50 and E'50 of amplitude 50. The main part of the energy penetrates into the cartridges 7 and 8. A 10% fraction (this value is given merely as an example, to facilitate understanding of the invention) is reflected in the form of two waves E*r* 5 and E*r*'5, of amplitude $50 \times 0.1 = 5$.

The two waves E 50 and E'50 are, as already mentioned, opposed in phase. But one of them travels twice through one quarter of the wavelength in the guide, that is to say through altogether ½ of a wavelength further than the other. The two waves E*r*5 and E*r*'5 appear in phase at the centre of the T.

From the branch 1 there issues a wave E 10 of amplitude 10, which is totally reflected by the mirror 6 and divides itself into two waves E 5 and E'5, each of amplitude 5, in the branches 2 and 3.

Each of these waves penetrates to the extent of 90% into the cartridges 7 and 8. All that remains is two reflected waves E*r* 0.5 and E*r*' 0.5, which are lost and return to the magnetron.

Consequently the apparent reflection of the two cartridges is only 1%.

What we claim is:

1. Applicator for applying microwaves to a material divided into two portions each of which has its inlet face comprising:

two waveguides electromagnetically decoupled from each other in which are respectively located said two portions, means for generating microwaves and for sending them onto said inlet faces so as to obtain two separate beams reflected by the inlet faces, means for shifting the phase of said beams, so as to obtain in phase beams, means for returning said in phase beams onto the inlet faces.

2. A process for applying microwaves to a material comprising:

dividing the material into two portions which are electromagnetically decoupled, each portion having an inlet face, applying respectively two incident beams of microwaves to the inlet faces so as to obtain two reflected beams reflected by the inlet faces, putting in phase said two reflected beams to obtain two in phase reflected beams, superposing said two in phase reflected beams to obtain one superposed beam, and, returning said superposed beam onto the material.

3. Process according to claim 2 consisting in dividing the superposed beam into two equal parts, each sent into one portion of the material.

4. Process according to claim 3, consisting in putting the reflected waves in phase by arranging the two portions in such a way that the lengths of the paths followed by the incident waves opposed in phase as far as the inlet faces differ by $(2k + 1)$ where $k$ is a whole number and $\lambda$ is the wavelength, and reflecting the superposed beam again onto the inlet faces.

* * * * *